US007281998B2

(12) United States Patent
Tanner

(10) Patent No.: US 7,281,998 B2
(45) Date of Patent: Oct. 16, 2007

(54) HEIGHT ADJUSTMENT MECHANISM FOR BATTING TEE

(76) Inventor: Joe H. Tanner, 3918 Meadow Creek La., Sarasota, FL (US) 34233

( * ) Notice: Subject to any disclaimer, the term of this patent is extended or adjusted under 35 U.S.C. 154(b) by 90 days.

(21) Appl. No.: 11/266,752

(22) Filed: Nov. 4, 2005

(65) Prior Publication Data

US 2007/0105662 A1 May 10, 2007

(51) Int. Cl.
*A63B 71/00* (2006.01)

(52) U.S. Cl. ..... 473/417; 473/422; 473/451

(58) Field of Classification Search ..... 473/417, 473/422, 419, 386, 387; 124/5, 16
See application file for complete search history.

(56) References Cited

U.S. PATENT DOCUMENTS 6,358,163 B1 3/2002 Tanner
6,398,671 B1 * 6/2002 Rios ..... 473/417
6,682,445 B1 1/2004 Tanner
6,893,363 B1 * 5/2005 Chen et al. ..... 473/417

* cited by examiner

*Primary Examiner*—Mitra Aryanpour
(74) *Attorney, Agent, or Firm*—Michael C. Cesarano; Feldman Gale P. A.

(57) ABSTRACT

An improved height adjustment mechanism for a batting tee uses an adjustment screw that attaches a compressible washer assembly to the bottom of an inner telescoping member to spread a compressible washer, thereby increasing the diameter of the compressible washer assembly and consequently adjusting internal friction between the washer assembly and the inner surface of an outer telescoping member to a desired amount necessary to hold the inner telescoping member stationary within the external telescoping member while the tee is being used while still allowing manual height adjustment of the batting tee as may be desired by the batter.

8 Claims, 6 Drawing Sheets

HEIGHT ADJUSTMENT MECHANISM FOR BATTING TEE

BACKGROUND

This invention is a further improvement for a batting tee for baseball as disclosed in U.S. Pat. Nos. 6,358,163 and 6,682,445 to Tanner.

A batting tee is used by baseball players to practice hitting baseballs held at various positions within or near to the strike zone. By using a batting tee to practice hitting a stationary ball, players can improve their batting swings and learn to hit balls from various locations within and near to the strike zone. Because many players wish to practice hitting balls from locations that are awkward or unfamiliar to them, or from which the player has previously experienced difficulty hitting a ball, it is a common accident for players to strike the batting tee with the bat, rather than to cleanly hit the baseball held atop the tee. The result is that batting tees typically suffer tremendous physical abuse throughout their lives.

U.S. Pat. No. 6,358,163 discloses a durable batting tee having a number of specialized features intended to avoid wear, tear, and breakage to which a typical batting tee is subjected. Amongst these features are a split washer that is used within a nut and threaded compression fitting to enable a batter to tighten the split washer about the tee to hold the ball at a desired height. The compression fitting was used to enable the tee to withstand impacts from a bat, yet still be able to be tightened sufficiently to hold the telescoping members at a desired position. Although this feature works well for its purpose, it does have the drawback of requiring a batter to twist the compression fitting in order to loosen it for adjustment of the telescoping member, and to twist it in the opposite direction to tighten the fitting when the proper height is obtained.

The problem of maintaining the ball holder at a desired height using a telescoping configuration was addressed in U.S. Pat. No. 6,682,445 to Tanner, in which an elongated split washer having an circumferential flange was used to increase friction between two telescoping members. The solution provided in the '682 patent, however, has the drawback that the elongated washer may, over time and repeated impacts from the tee's being struck by a bat, become loose or otherwise incapable of maintaining the requisite friction between telescoping members. Should that occur, the upper telescoping members may begin to slide downwardly due to the force of gravity, and one of the major benefits of the improved batting tee may be compromised. What is needed is a friction-producing mechanism that can be adjusted or regulated from time to time over the life of the tee to maintain the requisite amount of friction between telescoping members.

SUMMARY AND OBJECTS OF THE INVENTION

This invention uses an improved structure for holding two telescoping pieces in a set relationship without the need for a threaded compression fitting. This invention uses a compressible washer whose circumference will expand when the washer is compressed. In one embodiment, the washer is sandwiched between two rigid washers which, when pressed together, produce the compression that causes the compressible washer's circumference to expand. The compression assembly is situated at the base of an inner telescoping member, and the washer's outermost edge touches the inner surface of an outer telescoping member throughout substantially a 360 degree circumference. The frictional force between the washer and the inner surface of the outer telescoping member can be increased by compressing the washer. Compression can be increased or decreased by adjusting a longitudinally situated screw that holds the adjustment mechanism to the base of the inner telescoping member. An optional sleeve may be used near the lower end of the inner telescoping member to improve the stability of the tee and to act as a stop to prevent the inner telescoping member from being inadvertently extracted from the outer telescoping member when the tee is being raised. As used in a batting tee, the apparatus of this invention can be periodically adjusted to keep the batting tee at the desired heights, and thereby extend the useful life of the tee.

It is an object of this invention to provide an improved batting tee that does not require an external threaded compression coupling to maintain sufficient friction to hold two telescoping members in a desired stationary position while still permitting manual adjustment of the height. It is another object of the invention to provide an adjustment mechanism for adjusting the friction between two telescoping members such that, as the batting tee suffers repeated impacts from being hit with a bat, the mechanism may be adjusted to provide sufficient friction for maintaining the tee at a desired height. It is yet another object of the invention to provide a mechanism that may be easily adjusted with a screw driver or similar tool simply by inserting the tool into the open end of one telescoping member to tighten an adjustment screw.

DETAILED DESCRIPTION OF THE DRAWINGS AND PREFERRED EMBODIMENTS

Figure 1:
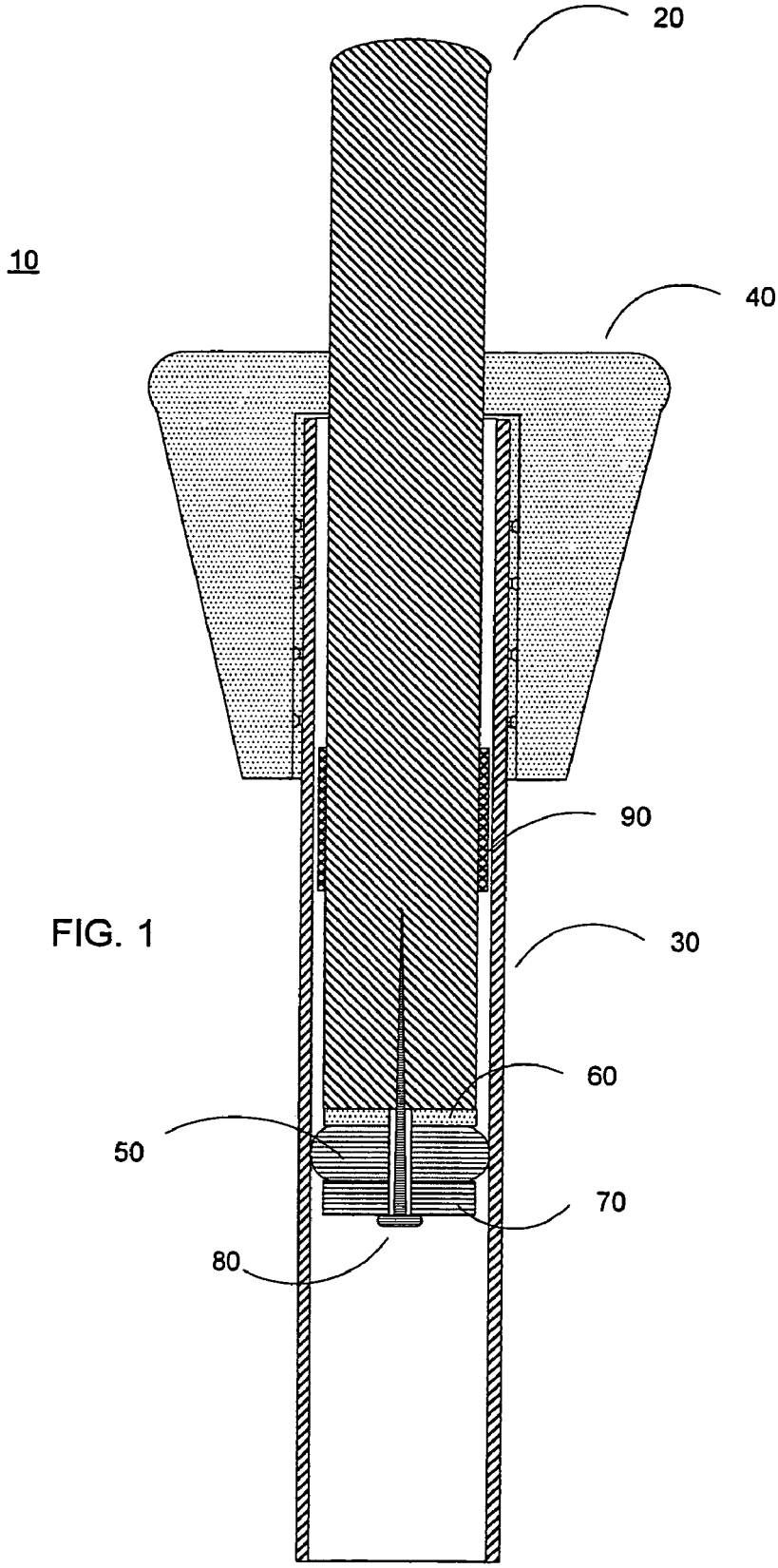
FIG. 1 is a cross-section elevational view of inner and outer telescoping members in which the adjustment mechanism of this invention is located on the inner telescoping member.

FIG. 1 depicts a cross-section elevational view of the adjustment mechanism of this invention. A batting tee 10 comprises an inner telescoping member 20 to which a ball holder (not shown) is mounted at the top. The inner telescoping member 20 is preferably impact resistant and has both substantial rigidity and modest flexibility. An outer telescoping member 30 extends downwardly to a base (not shown) or to a lower telescoping member (not shown) either of which will provide support to outer telescoping member 30, holding it in a vertical orientation. A flexible support 40 is mounted over the upper end of outer telescoping member 30, and has a center opening through the uppermost portion of its center. Inner telescoping member 20 fits through the opening. There is contact between the outer circumference of the inner telescoping member 20 and the edges of the center opening through the flexible support 40. Where greater support is desired, the center opening in the flexible support 40 may be made to a slightly smaller diameter than the diameter of the inner telescoping member 20.

At the lower end of the inner telescoping member 20 is attached a pair of rigid washers, 60, 70, between which is sandwiched a compressible washer 50. The assembly of washers 50, 60 and 70 is attached to the lower end of inner telescoping member 20 by an adjusting screw 80 that extends through the washers and is held within a screw hole in the lower end of inner telescoping member 20. Compressible washer 50 may be made if rubber or of any other synthetic or natural material that will deform outwardly when placed under longitudinal compression. In a non-compressed state, compressible washer 50 assumes a shape in which the outer diameter of the washer is at a minimum. In this state, the outer circumference of flexible washer 50 may or may not be in frictional contact with the inner surface of outer telescoping member at every point on the circumference. The exact diameters of compressible washer 50 and the inner surface of inner telescoping member 20 may be designed to produce any desired amount of residual friction, including zero friction, when compressible washer 50 is in an uncompressed state.

An elongated spacer 90 may extend around the circumference of inner telescoping member 20 near the lower end of the member. Elongated spacer 90 reduces the space between the outer circumference of inner telescoping member 20 and the inner circumference of outer telescoping member 30, and assists in holding the two members in parallel relationship with respect to one another. Elongated spacer 90 also acts as a stop to prevent the inadvertent removal of the inner telescoping member from the outer telescoping member when the ball holder is being raised.

Figure 2:
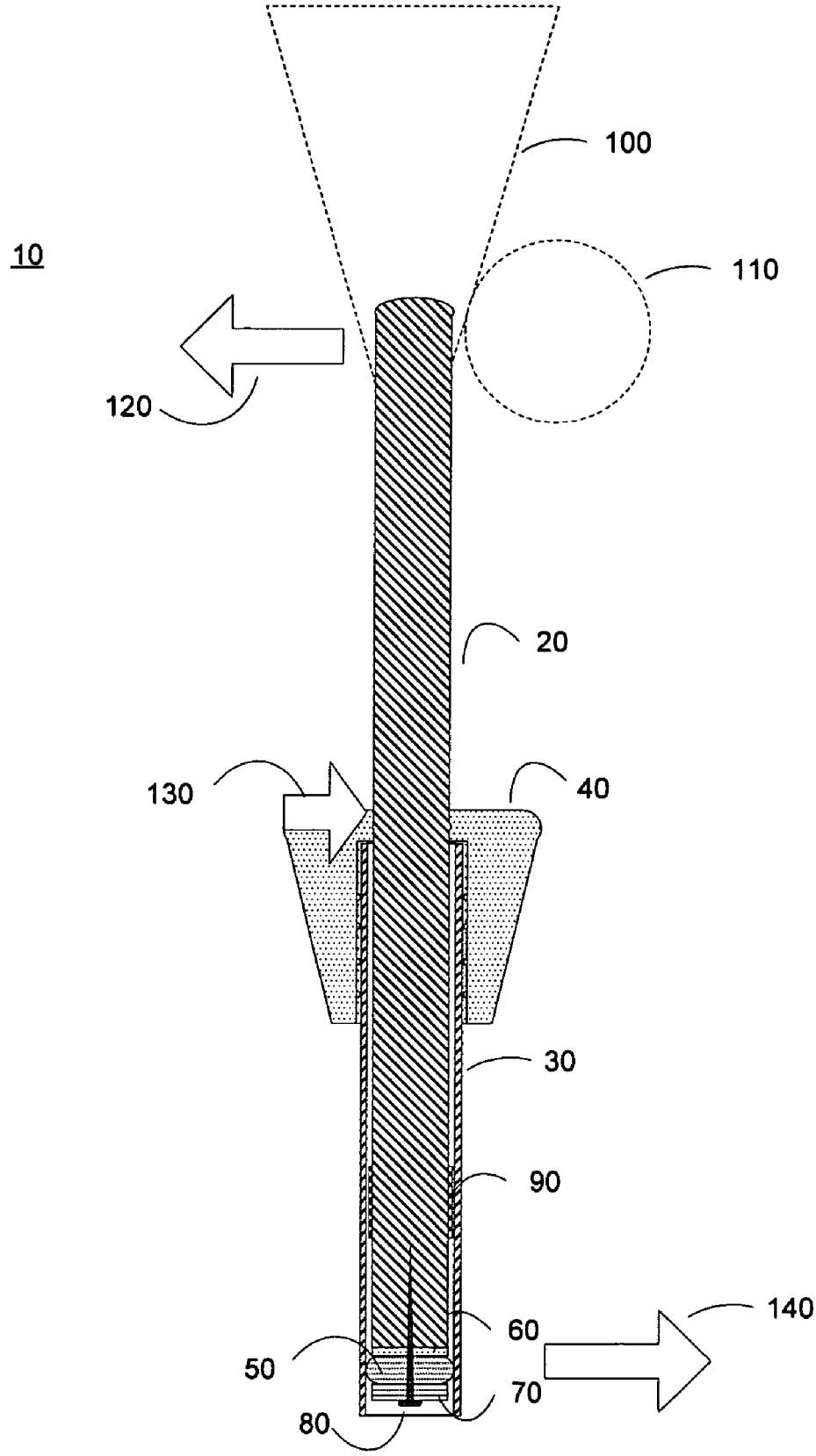
FIG. 2. is a detailed view of the adjustment mechanism of the invention.

As shown in FIG. 2, when the batting tee is used, the bat 110 (shown in phantom) will occasionally strike the cup holder 100 (also shown in phantom) or some other part of the tee. Such impacts, repeated over time, tend to be destructive of the batting tee, but may be alleviated by using a slightly flexible material for inner telescoping member 20. In one embodiment, the inner telescoping member is made from an acetal polyoxymethylene copolymer. This material is sold by DuPont under the trademark Delrin®.

When the tee is inadvertently struck by the bat, the upper portion of inner telescoping member 20 receives an impact in the direction of arrow 120, giving inner telescoping member a rotational tendency to spin end over end about a fulcrum formed by the center opening of the flexible support 40, and represented by arrow 130. The lower portion of inner telescoping member will thus be given a lateral impetus, represented by arrow 140, against the inner circumferential surface of outer telescoping member 30.

Actual rotational movement of inner telescoping member 20 is prevented in part by compressible washer 50, which is forced against the inner circumferential surface of outer telescoping member 30, and in part by elongated spacer 90, whose lateral movement will be arrested when it comes into contact with the inner circumferential surface of outer telescoping member 30. Although compressible washer 50 is forced against the inner circumferential surface of outer telescoping member 30 when the tee is so struck, thereby causing some deformity in compressible washer 50, the amount of such deformity caused by such contact is limited by the fact that elongated spacer 90 also comes into contact with the inner circumferential surface of outer telescoping member, thereby restricting the allowable movement of the lower end of inner telescoping movement about the fulcrum 130. By limiting the maximum amount of impact deformity experienced by compressible washer 50 when the tee is struck by a bat, the longevity and durability of compressible washer 50, hence of the batting tee, are significantly improved over batting tees found in the prior art.

Figure 3:
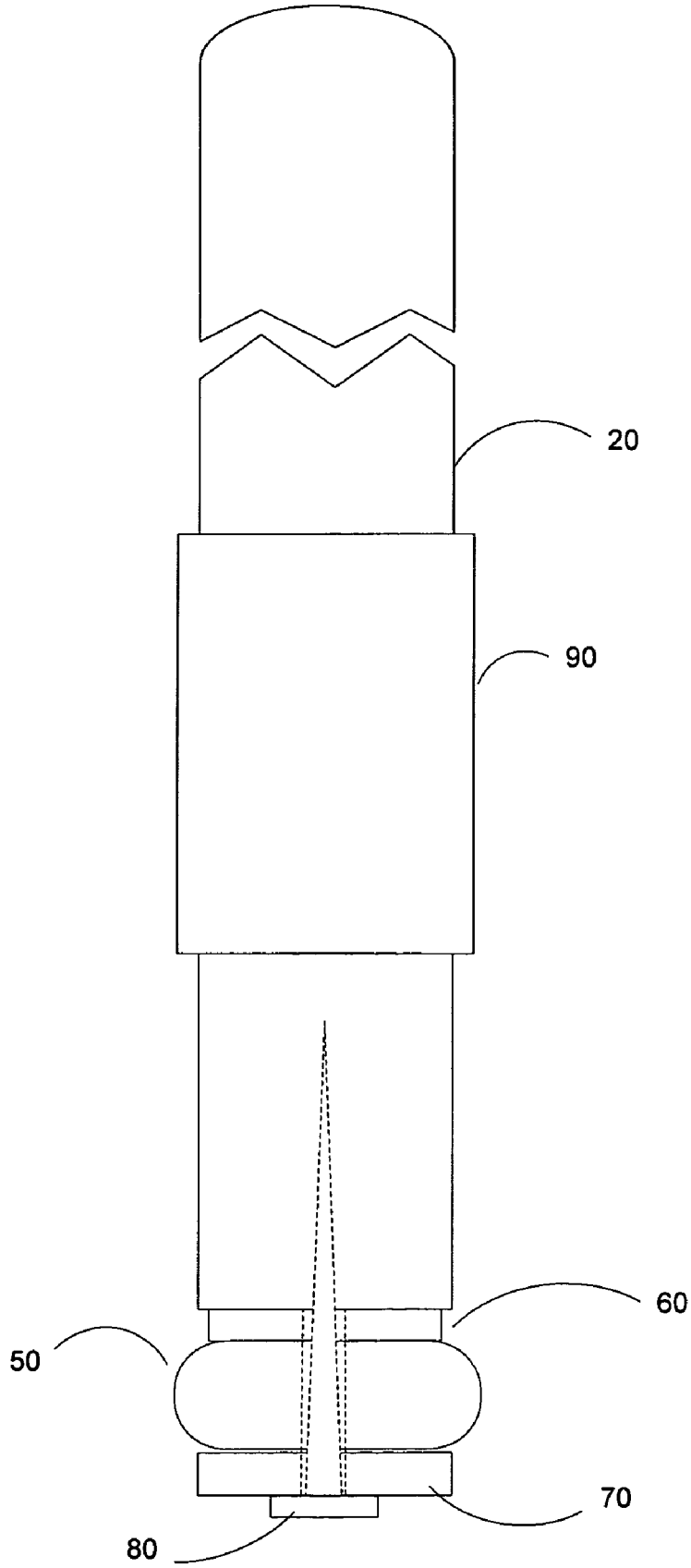
FIG. 3 is an elevational view of the adjustment mechanism on an inner telescoping member in which the washer is not compressed.

FIG. 3 depicts the adjustment mechanism with the compressible washer in an uncompressed state. The lower end of inner telescoping member 20 is shown with elongated spacer 90 extending circumferentially around inner telescoping member 20. In one embodiment, rigid washer 60 acts as a spacer to hold flexible washer 50 slightly apart from the lower extremity of inner telescoping member 20, and has a diameter that is slightly less than that of compressible washer 50. Lower washer 70 has a larger diameter than adjusting screw 80, and transmits the compressive force of adjusting screw 80 against the bottom surface area of compressible washer 50. In a preferred embodiment, adjusting screw 80 is tapered and remains firmly held within inner telescoping member 20 through frictional forces acting upon contacting surfaces. By tightening or loosening adjusting screw 80, the diameter of compressible washer when not confined within outer telescoping member 30 may be increased or decreased.

Figure 4:
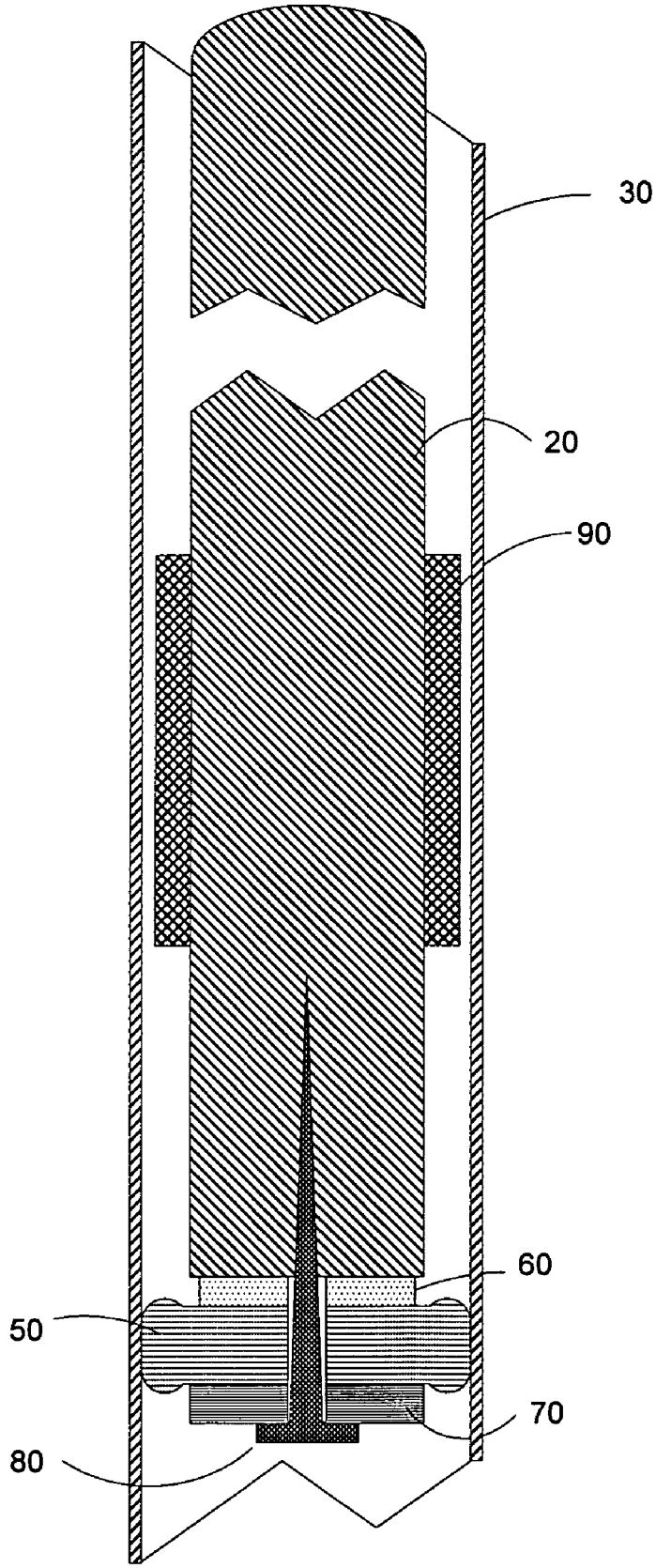
FIG. 4 is a cross-section elevational view of two telescoping members in which the washer of the adjustment mechanism has been compressed.

As depicted in FIG. 4, when inner telescoping member 20 is inserted within outer telescoping member 30, the tightening of adjustment screw 80 increases both the area of surface contacted between compressible washer 50 and the inner surface of outer telescoping member 30, and the pressure, hence amount of friction, at the points of contact. The increased friction holds inner telescoping member at a fixed position within outer telescoping member while the tee is in use. Over time, and with extended use, the friction between flexible washer 50 and the inner surface of outer telescoping member 30 may decrease, and inner telescoping member 20 may begin to slip while the tee is in use. When this happens, the friction may be increased simply by tightening adjusting screw 80 to cause greater friction between the compressible washer and outer telescoping member 30.

As friction may be adjusted to be greater or lesser simply by tightening or loosening adjusting screw 80, the amount of force required to raise or lower the inner telescoping member within the outer telescoping member may be adjusted as necessary to permit raising or lowering of the tee when desired while maintaining a fixed positioning of the telescoping members when the tee is being used.

Figure 5:
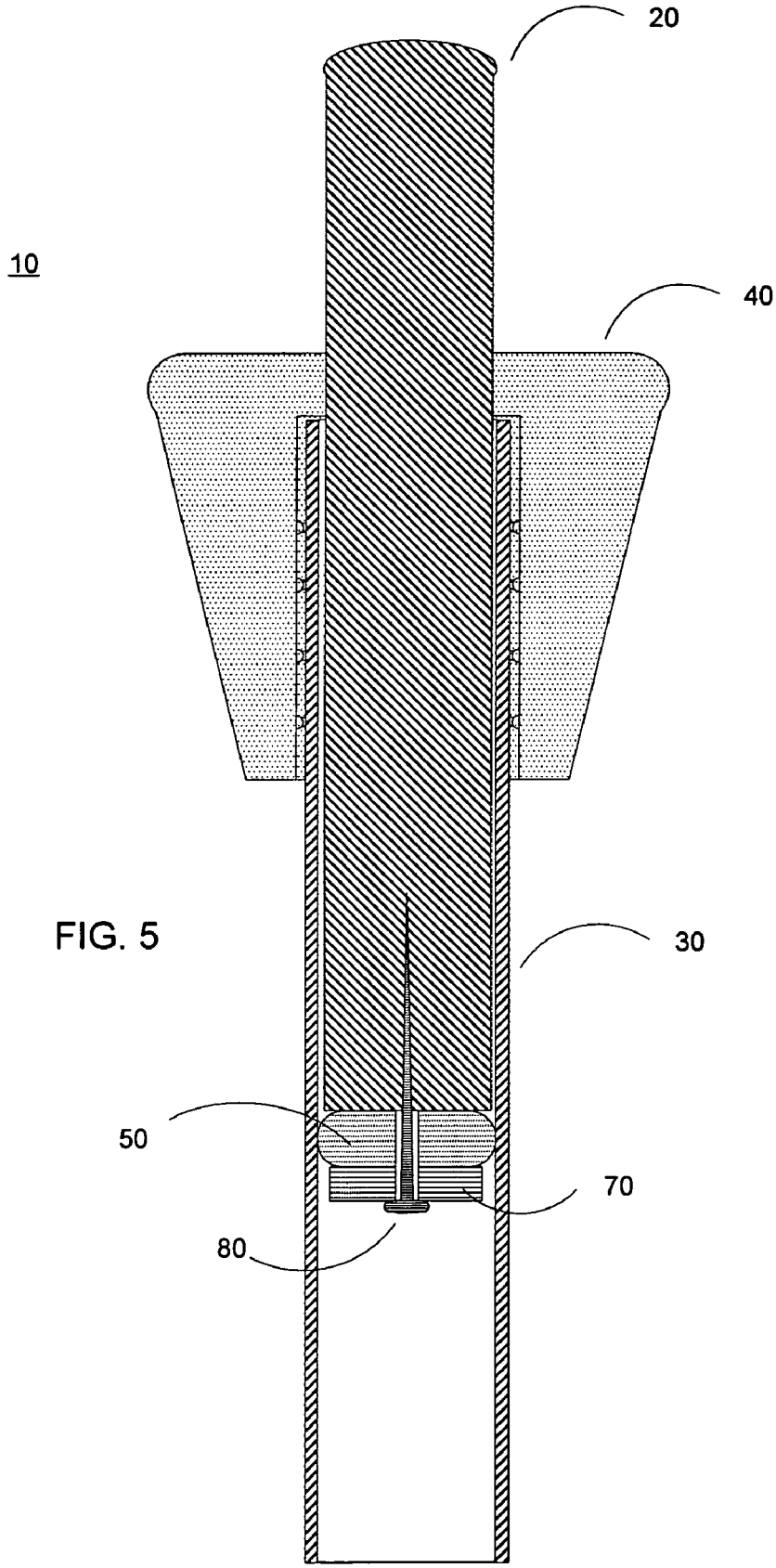
FIG. 5 is an alternative embodiment of the view shown in FIG. 1.
Figure 6:
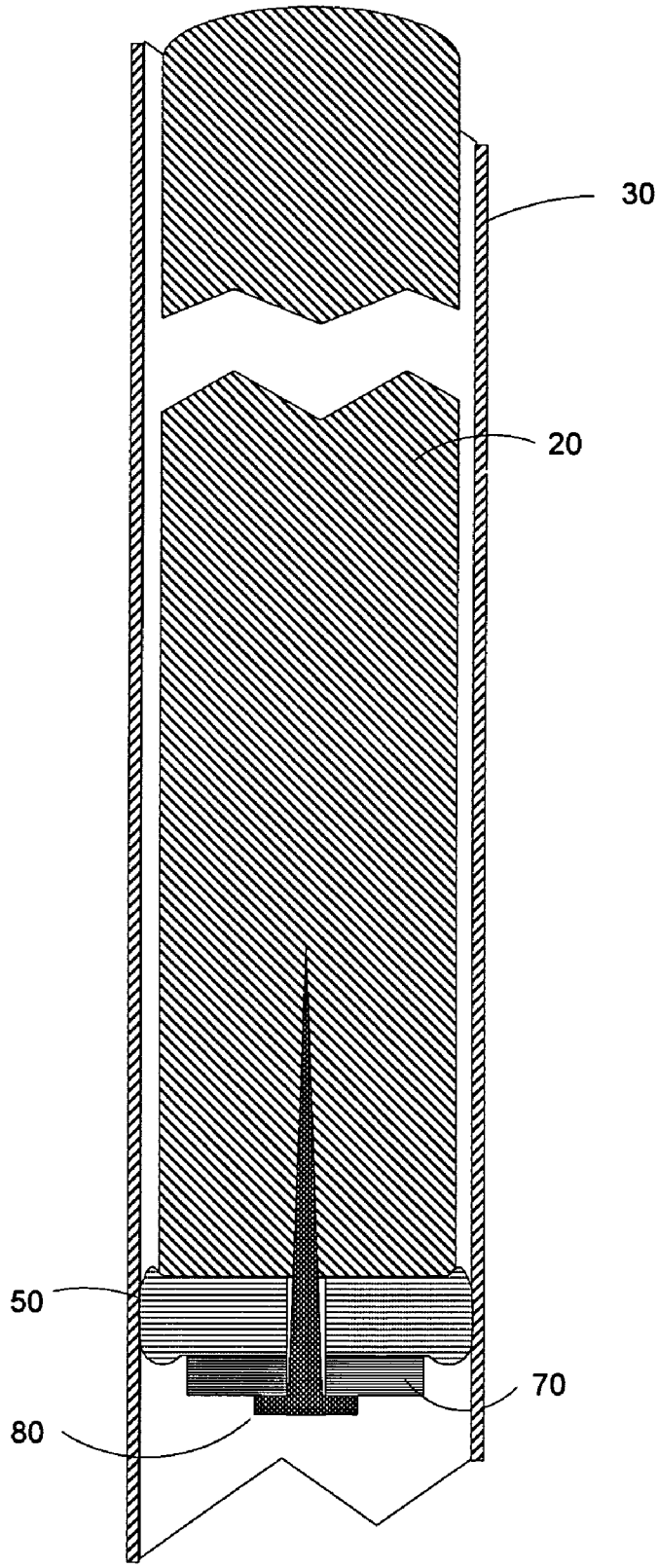
FIG. 6 is an alternative embodiment of the view shown in FIG. 4.

FIGS. 5 and 6 depict an alternative embodiment of the adjustment mechanism of this invention in which elongated spacer 90 and rigid washer 60 have been omitted from the compressible washer assembly, and compressible washer 50 is compressed between rigid washer 70 and the lower end of inner telescoping member 20. In FIG. 5, compression is at a minimum, and the friction between compressible washer 50 and the inner surface of outer telescoping member 30 permits the easy sliding of inner telescoping member 20 within outer telescoping member 30.

In FIG. 6, compressible washer 50 has been compressed between the lower end of inner telescoping member 20 and rigid washer 70 through the tightening of adjustment screw 80. As a result of such compression, compressible washer 50 has deformed to create greater surface contact between itself and the inner surface of outer telescoping member 30, and hence, greater friction is generated to resist the sliding of the inner telescoping member within the outer telescoping member.

FIGS. 5 and 6 also depict the inner telescoping member without an elongated spacer. In this embodiment, the diameter of the inner telescoping member is only slightly smaller than the inner diameter of outer telescoping member, and the amount of available lateral movement of the inner telescoping member within the outer telescoping member when the tee is inadvertently struck with a bat is correspondingly limited. The elimination of elongated spacer 90 is compensated for by decreasing the space between the inner and outer telescoping members. However, as tolerances between the respective diameters of the inner and outer telescoping members must be substantially more precise, the costs of manufacturing this embodiment of the invention may be substantially greater.

Although the present invention has been particularly shown and described with reference to a preferred embodiment, it will be understood by those skilled in the art that various changes in form and detail may be made without departing from the spirit and scope of the invention.

I claim:

1. An adjustment mechanism for a batting tee having at least an inner telescoping member and an outer telescoping member, said adjustment mechanism comprising:

a first rigid washer, a second rigid washer, a compressible washer, and an adjustment screw, the center hole of said compressible washer being aligned with the center holes of said first and second rigid washers, said compressible washer being situated between said first and second rigid washers to form a compressible washer assembly having an outer diameter and a center hole extending through said centers of said aligned rigid and compressible washers, said outer diameter of said compressible washer assembly becoming greater when said compressible washer assembly is compressed, said inner telescoping member having an upper and a lower portion, said lower portion having a cylindrical shape of constant diameter, a lower end, and a screw hole situated longitudinally within said lower end of said inner telescoping member, said adjustment screw extending through said center hole of said compressible washer assembly and extending into said screw hole such that said adjustment screw holds said compressible washer assembly against said lower end of said inner telescoping member, said screw hole being of sufficient length to permit said adjustment screw to be tightened against said compressible washer assembly, such that when said adjustment screw is tightened said compressible washer assembly will be compressed against said lower end of said inner telescoping member and said outer diameter of said compressible washer assembly will be increased, said outer telescoping member having a circumferential opening therethrough, said circumferential opening having a constant diameter large enough to accept said lower portion of said inner telescoping member in a slidable relationship when said compressible washer assembly is not compressed, and to provide sufficient friction between said compressible washer assembly and said circumferential opening to prevent said inner telescoping member from sliding within said outer telescoping member when said compressible washer assembly is compressed.

2. The adjustment mechanism for a batting tee as claimed in claim 1, further comprising an elongated spacer situated around said lower portion of said inner telescoping member, said elongated spacer having an outer diameter that is smaller than the inner diameter of said circumferential opening in said outer telescoping member.

3. The adjustment mechanism for a batting tee as claimed in claim 1, further comprising said inner telescoping member being formed of an acetal polyoxymethylene copolymer.

4. The adjustment mechanism for a batting tee as claimed in claim 2, further comprising said inner telescoping member being formed of an acetal polyoxymethylene copolymer.

5. An adjustment mechanism for a batting tee having at least an inner telescoping member and an outer telescoping member, said inner telescoping member having an upper and a lower portion, said lower portion having a cylindrical shape, a constant diameter, a lower end, and a screw hole situated longitudinally within said lower end of said inner telescoping member, said adjustment mechanism comprising:

a rigid washer, a compressible washer, and an adjustment screw, the center holes of said compressible washer and said rigid washer being aligned, said compressible washer being situated between said rigid washer and said lower end of said inner telescoping member and having an outer diameter, said outer diameter of said compressible washer becoming greater when said compressible washer is compressed, said adjustment screw extending through said center holes of said rigid washer and said compressible washer and extending into said screw hole such that said adjustment screw holds said rigid washer and said compressible washer securely against said lower end of said inner telescoping member, said screw hole being of sufficient length to permit said adjustment screw to be tightened against said rigid washer and said compressible washer, such that when said adjustment screw is tightened said compressible washer will be compressed between said rigid washer and said lower end of said inner telescoping member and said outer diameter of said compressible washer will be increased, said outer telescoping member having a circumferential opening therethrough, said circumferential opening having a constant diameter large enough to accept said lower portion of said inner telescoping member in a slidable relationship when said compressible washer is not compressed, said compressible washer contacting the inner surface of said circumferential opening to provide friction between said compressible washer and the surface of said circumferential opening to prevent said inner telescoping member from sliding within said outer telescoping member when said compressible washer is compressed.

6. The adjustment mechanism for a batting tee as claimed in claim 5, further comprising an elongated spacer situated around said lower portion of said inner telescoping member, said elongated spacer having an outer diameter that is smaller than the inner diameter of said circumferential opening in said outer telescoping member.

7. The adjustment mechanism for a batting tee as claimed in claim 5, further comprising said inner telescoping member being formed of an acetal polyoxymethylene copolymer.

8. The adjustment mechanism for a batting tee as claimed in claim 6, further comprising said inner telescoping member being formed of an acetal polyoxymethylene copolymer.

* * * * *